US010968669B2

(12) United States Patent
McLeod et al.

(10) Patent No.: US 10,968,669 B2
(45) Date of Patent: Apr. 6, 2021

(54) SYSTEM AND METHOD FOR INDUCTIVE POWER TRANSFER TO DOOR

(71) Applicant: Sensormatic Electronics, LLC, Boca Raton, FL (US)

(72) Inventors: Murdo Jamie Scott McLeod, Belfast (GB); Walter A. Martin, Ballymena (GB)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 447 days.

(21) Appl. No.: 15/690,743

(22) Filed: Aug. 30, 2017

(65) Prior Publication Data

US 2019/0063128 A1 Feb. 28, 2019

(51) Int. Cl.
*E05C 19/16* (2006.01)
*E05B 47/00* (2006.01)

(52) U.S. Cl.
CPC ..... *E05C 19/166* (2013.01); *E05B 47/0002* (2013.01); *E05B 2047/0058* (2013.01); *E05B 2047/0061* (2013.01); *E05B 2047/0068* (2013.01); *E05B 2047/0082* (2013.01); *E05B 2047/0094* (2013.01)

(58) Field of Classification Search
CPC .. H02J 7/025; H02J 50/10; H02J 5/005; H02J 17/00; G07C 2009/00634; G07C 2009/00611; G07C 9/00722; H04B 5/0037; H04B 5/0012; H04B 2047/0061; E05B 2047/0061; E05B 47/00; E05B 47/0002; E05B 2047/0059; E05B 2047/0082; E05C 19/166; H01F 2038/146; H01F 38/14; H01F 2007/1692; H01F 7/1805; Y10T 292/11; Y10T 70/7904
See application file for complete search history.

(56) References Cited

U.S. PATENT DOCUMENTS 4,682,801 A * 7/1987 Cook ..... E05C 19/166 292/251.5
5,195,341 A * 3/1993 Nieuwkoop ..... G07C 9/00309 70/278.3
6,259,352 B1 7/2001 Yulkowski et al.
6,282,407 B1 8/2001 Vega et al.
6,720,861 B1 4/2004 Rodenbeck et al.
(Continued)

*Primary Examiner* — Mark A Williams
(74) *Attorney, Agent, or Firm* — HoustonHogle LLP

(57) ABSTRACT

A system and method for a door is disclosed. The system includes a frame magnetic lock assembly mounted to a door frame, and a door magnetic lock assembly mounted to a door for receiving inductively transferred power from the frame magnetic lock assembly. The door system also includes a door electronics subsystem mounted to the door that includes a power management system that provides power to the door from the inductively transferred power, and charges an energy storage element at the door from the inductively transferred power. The power management system provides power to the door from the energy storage element when the inductively transferred power is not available at the door, such as when the door is open, and resumes providing power to the door from the inductively transferred power once the inductively transferred power is restored. Once restored, some of the inductive power recharges the energy storage element.

20 Claims, 5 Drawing Sheets

(56) References Cited

U.S. PATENT DOCUMENTS 8,772,978 B2 * 7/2014 Ichikawa ..... H02J 7/0044 307/104
9,845,623 B1 12/2017 Gage
9,984,523 B1 * 5/2018 Shen ..... G07C 9/00174
10,158,831 B1 12/2018 Taub
2005/0116480 A1 * 6/2005 Deng ..... E05B 47/0676 292/289
2006/0114099 A1 * 6/2006 Deng ..... G07C 9/00563 340/5.53
2007/0124427 A1 5/2007 Light et al.
2007/0146115 A1 * 6/2007 Roosli ..... G07C 9/00103 340/5.6
2007/0198850 A1 8/2007 Martin et al.
2007/0204663 A1 9/2007 Lee
2008/0017726 A1 1/2008 Neumann
2008/0209965 A1 9/2008 Maack
2008/0218330 A1 9/2008 Biles et al.
2008/0222963 A1 9/2008 Zwart
2009/0302995 A1 12/2009 Park
2010/0097225 A1 4/2010 Petricoin, Jr.
2010/0290542 A1 * 11/2010 Peabody ..... E05B 17/22 375/258
2012/0267962 A1 * 10/2012 Hanchett, Jr. ..... H02J 50/80 307/104
2013/0167190 A1 6/2013 Jankowski et al.
2013/0260676 A1 * 10/2013 Singh ..... H04B 5/0037 455/41.1
2013/0342342 A1 12/2013 Sabre et al.
2014/0159388 A1 6/2014 Liao
2014/0265359 A1 9/2014 Cheng et al.
2014/0274033 A1 9/2014 Smart et al.
2014/0282048 A1 9/2014 Shapiro et al.
2014/0292096 A1 10/2014 Yamada
2014/0340032 A1 * 11/2014 Curtis ..... G07C 9/00174 320/108
2015/0116082 A1 4/2015 Cregg et al.
2015/0211270 A1 7/2015 Benhammou
2015/0243195 A1 8/2015 Escobedo et al.
2015/0249548 A1 9/2015 Rasband et al.
2015/0348220 A1 12/2015 Sharma et al.
2016/0047144 A1 2/2016 McMillan et al.
2016/0077575 A1 3/2016 Paul et al.
2016/0087687 A1 * 3/2016 Kesler ..... H04B 5/0037 307/104
2016/0275781 A1 9/2016 Nold
2016/0307683 A1 * 10/2016 Davis ..... E05B 47/02
2016/0343181 A1 11/2016 Cheng et al.
2017/0091998 A1 3/2017 Piccolo, III
2017/0186254 A1 6/2017 Dumas et al.
2017/0228603 A1 8/2017 Johnson
2017/0238401 A1 8/2017 Sadwick et al.
2017/0243455 A1 8/2017 Johnson et al.
2017/0263065 A1 9/2017 Johnson
2017/0284129 A1 10/2017 King
2017/0332055 A1 11/2017 Henderson
2017/0373723 A1 * 12/2017 Toivonen ..... H04B 5/0037
2018/0058099 A1 3/2018 Wurm
2018/0075961 A1 3/2018 Davis et al.
2018/0076664 A1 3/2018 Wright
2018/0213191 A1 7/2018 Shen
2019/0186181 A1 6/2019 Robertson

* cited by examiner

SYSTEM AND METHOD FOR INDUCTIVE POWER TRANSFER TO DOOR

RELATED APPLICATIONS

U.S. application Ser. No. 15/690,763 filed on Aug. 30, 2017, entitled "System and Method for Providing Communication Over Inductive Power Transfer to Door," now U.S. Patent Publication No.: US 2019/0066419 A1; and U.S. application Ser. No. 15/690,770 filed on Aug. 30, 2017, entitled "Door System and Method of Operation Thereof,"now U.S. Patent Publication No.: US 2019/0066413 A1.

All of the afore-mentioned applications are incorporated herein by reference in their entirety.

BACKGROUND OF THE INVENTION

Security systems are often installed within and around buildings such as commercial, residential, or governmental buildings. Examples of these buildings include offices, hospitals, warehouses, schools or universities, shopping malls, government offices, and casinos. The security systems typically include components such as system controllers, access control systems, access control readers, video surveillance cameras, network video recorders (NVRs), and door control modules, to list a few examples.

Access control systems in buildings, for example, are principally concerned with physical security and the selective access to, restriction of, and/or notification of access to a place or other resource. Historically, the main components of the access control systems were access control readers and possibly door control modules and possibly door locking systems. The access control readers were often installed to enable presentation of credentials to obtain access to restricted areas, such as buildings or areas of the buildings. The readers were installed near access points, such as doors or hallways or elevators. Typically, individuals would interact with the access control readers by swiping keycards or bringing contactless smart cards within range (approximately 2-3 inches or 5 centimeters) of the reader. The access control readers would read the credential information of the keycards and validate the information possibly by reference to a verification system that confirmed the credentials and determined if the individuals were authorized to access the restricted areas. If the individuals were authorized, then the door control modules might be signaled to operate the door locking system to unlock doors, for example.

The access control readers are most often mounted to a wall next to a door frame of the door, and input power is usually provided to each of the readers via electrical cabling within the walls near each door.

The door locking systems can take a number of forms. Some systems include mechanical release latches on the doorframe that are directly controlled by the door control module. In other examples, the door locking systems are battery-powered and included as part of the door knob assembly. These systems are common in hotels. Magnetic lock systems are still another example.

The magnetic lock systems typically include a number of components and are often controlled by the door control module. An electromagnet typically is mounted to the door frame of the door and an armature, a ferromagnetic plate, is mounted to the door. Electrical energy supplied to the electromagnet creates a magnetic field that attracts the ferromagnetic plate with enough force to keep the door closed. When a user presents valid credentials to access reader mounted at the door, in one example, the verification system sends a signal to the door control module for the door, which in turn deenergizes the electromagnet, thus allowing the door to be opened.

SUMMARY OF THE INVENTION

The typical approach to providing power to electronic systems on the door is to include a battery on the door, such as in the door knob assembly. Such systems have advantages in terms of low cost but are expensive in terms of maintenance since the batteries must be periodically replaced. Moreover, such systems will not be fail-safe since if the batteries are depleted of charge, then the door will remain locked. This limits the places in which they can be deployed.

Another potential solution to providing power to electronic systems on the door is to run electrical wiring to the door itself. Typically, the wiring is located near one of the door's hinges, near the top of the door. This approach can be used to avoid the necessity of having a battery on the door. The disadvantage, however, is the expense of installation. The electrical wiring must be run through the doorframe and through the door. Moreover, these systems suffer from maintenance issues since the repeated opening and closing of the door will cause the wiring to fatigue over time.

The present invention solves the problem of providing power to electronic systems on the door. Specifically, the magnetic lock system is augmented with an inductive power transfer system. As a result, power can be transmitted to the moving door without the need for new electrical wired connections. This transferred power can be used to recharge power energy storage elements on the door such as rechargeable batteries or capacitors. It can also be used to power other electronic systems on the door.

In general, according to one aspect, the invention features a system for a door. The system includes a frame magnetic lock assembly mounted to a door frame and a door magnetic lock assembly mounted to a door for receiving inductively transferred power from the frame magnetic lock assembly. In an embodiment, the frame magnetic lock assembly includes an inductive power transmitter that transfers the power.

The door magnetic lock assembly preferably includes an inductive power receiver that receives the inductively transferred power from the frame magnetic lock assembly. Additionally, the magnetic lock system includes a door electronics subsystem mounted to the door. The door electronics subsystem includes a power management system that provides power to the door from the inductively transferred power, a power bus that distributes power to the door, and a door controller that is powered by the power bus.

The magnetic lock system can also include a WiFi transceiver that provides data communication for the door controller and is powered via the power bus. Preferably, the power management system includes an energy storage element and a power conditioning circuit. The power conditioning circuit converts an AC power signal transduced from the inductively transferred power into a door DC power signal and charges the energy storage an energy storage element on the door with the door DC power signal. The door magnetic lock assembly can also include a door position sensor that indicates an open and/or closed state of the door.

The frame magnetic lock assembly can further include a frame communications antenna, connected to a frame communications transceiver, and the door magnetic lock assembly further comprises a door communications antenna, connected to a frame communications transceiver, for enabling communications between the door and the door frame. In one example, the frame communications transceiver and the door communications transceiver are near field communications (NFC) transceivers.

In general, according to another aspect, the invention features an access control system that includes a door control module, a frame magnetic lock assembly mounted to a door frame, and a door magnetic lock assembly mounted to a door for receiving inductively transferred power from the frame lock assembly.

In general, according to another aspect, the invention features a method for providing power to a door. The method includes a door magnetic lock assembly mounted to a door receiving inductively transferred power from a frame magnetic lock assembly mounted to a door frame. The method also includes providing power to the door from the inductively transferred power.

In one example, providing power to the door from the inductively transferred power is accomplished by converting an AC power signal transduced from the inductively transferred power into a door DC power signal, and charging an energy storage element on the door with the door DC power signal.

The method additionally includes providing power to the door from the energy storage element when the door is open. The method also includes providing power to the door from the energy storage element occurs in response to a door control module at the door frame unlocking the door, the door control module unlocking the door by deactivating a DC power unit that supplies power to the frame magnetic lock assembly.

The method also includes providing power to the door from the energy storage element when the inductively transferred power at the door is absent, and resuming providing power to the door from the inductively transferred power when the inductively transferred power at the door is restored.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
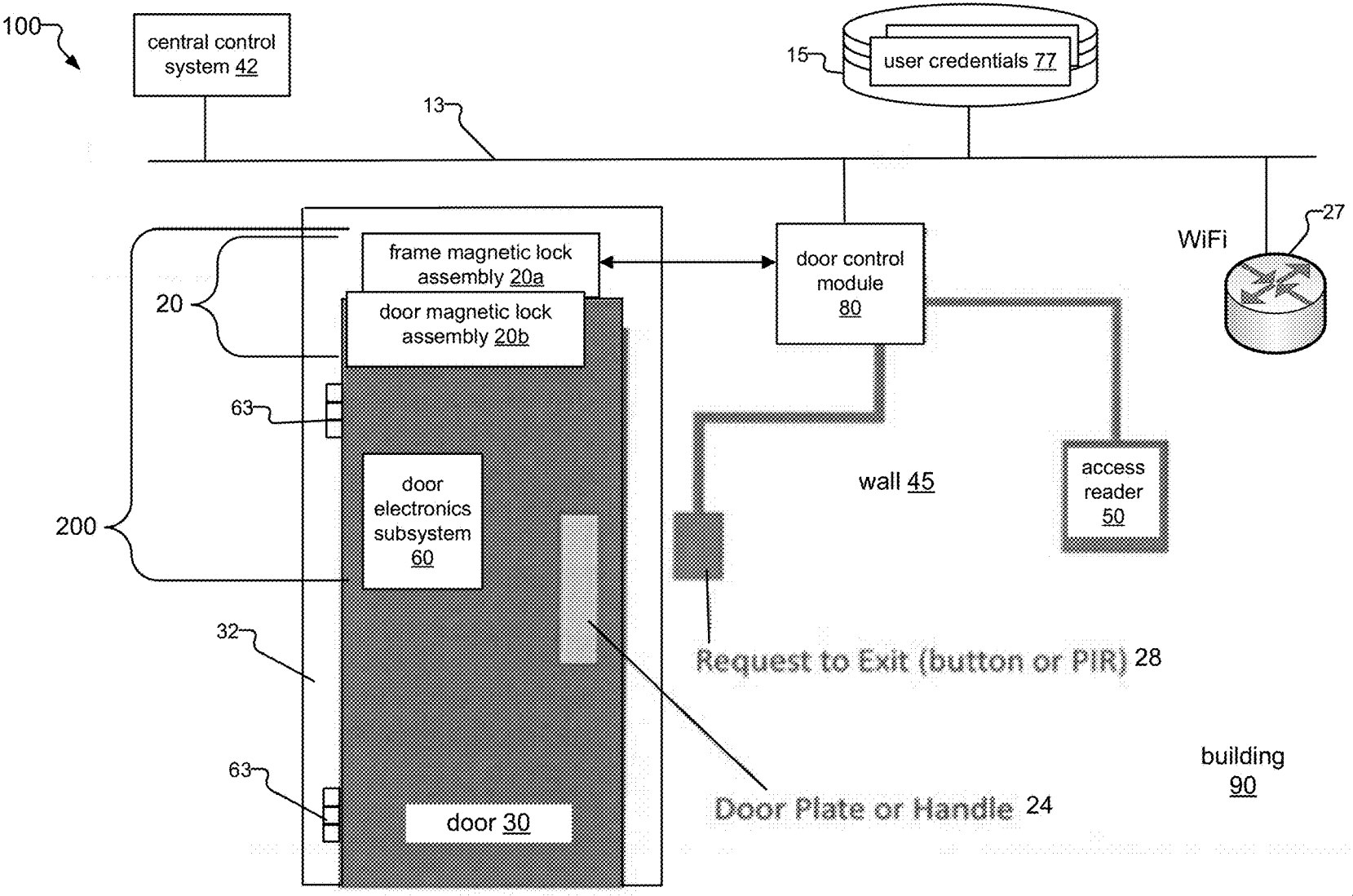
FIG. 1 is a schematic diagram of an exemplary access control system including the inventive magnetic lock system mounted to a door and door frame of the door, where the magnetic lock system includes a door magnetic lock assembly mounted to the door and a frame magnetic lock assembly mounted to the door frame.

FIG. 1 is a schematic diagram of an exemplary access control system 100 to which the invention is directed. The access control system 100 is installed at a premises such as a building 90.

Major components of the access control system 100 include a magnetic lock system 20 mounted between a door frame 32 and a door 30, a door control module 80, an access reader 50, a WiFi access point 27, and a central control system 42. The central control system 42, in one example, functions as a verification system for verifying user credentials 77 of users.

The door 30 is attached to the door frame 32 by hinges 63 that enable opening and closing of the door 30. The door 30 also includes a door electronics subsystem 60 and a handle/door plate 24. The magnetic lock system 20 and the door electronics subsystem 60 form a door system 200.

The access reader 50 is mounted to a wall 45 next to the door frame 32 of the door 30, and input power is usually provided to the access reader 50 via electrical cabling within the wall 45. The access reader 50 can also receive a signal from a request to exit device 28 mounted to the wall 45. In examples, the request to exit device 28 can be a simple button pressed by the user that sends the signal to the door control module 80, or a Passive Infra-Red (PIR) sensor that detects the presence of the user and sends the signal in response. The door control module 80, the access reader 50, and the request to exit device 28 are examples of equipment mounted near the door frame 32 of the access control system 100 that typically receive input power via electrical cabling within the wall 45.

The magnetic lock system 20 includes a frame magnetic lock assembly 20*a* mounted to the door frame 32 and a door magnetic lock assembly 20*b* mounted to the door 30. The frame magnetic lock assembly 20*a* receives power from the door control module 80, in one embodiment, and the door control module 80 communicates with the central control system 42 and the WiFi access point 27 over a local network 13. A database 15 connected to the local network 13 stores the user credentials 77 of users. Alternatively, in another implementation, the database 15 is directly connected to the central control system 42 rather than via the local network 13. The direct connection of the database 15 to the central control system 42 provides heightened data security for the user credentials of the users 77 and other information stored within the database 15.

Users at the door 30 typically present access cards including their user credentials 77 to the access reader 50 to obtain access to the building 90. The access reader 50 sends the user credentials 77 directly to the central control system 42 or to the door control module 80, which in turn forwards the user credentials 77 to the central control system 42 for verification. Upon verification of the user credentials 77, the central control system 42 sends a signal for unlocking the door 30 to the door controller module 80. The door controller module 80, in turn, sends a signal to the frame magnetic lock assembly 20*a* to unlock the door 30.

Though only one door 30 is shown, it can be appreciated that the door control module 80 can provide power to and control the locking and unlocking of multiple doors 30 within the building 90.

Figure 2A:
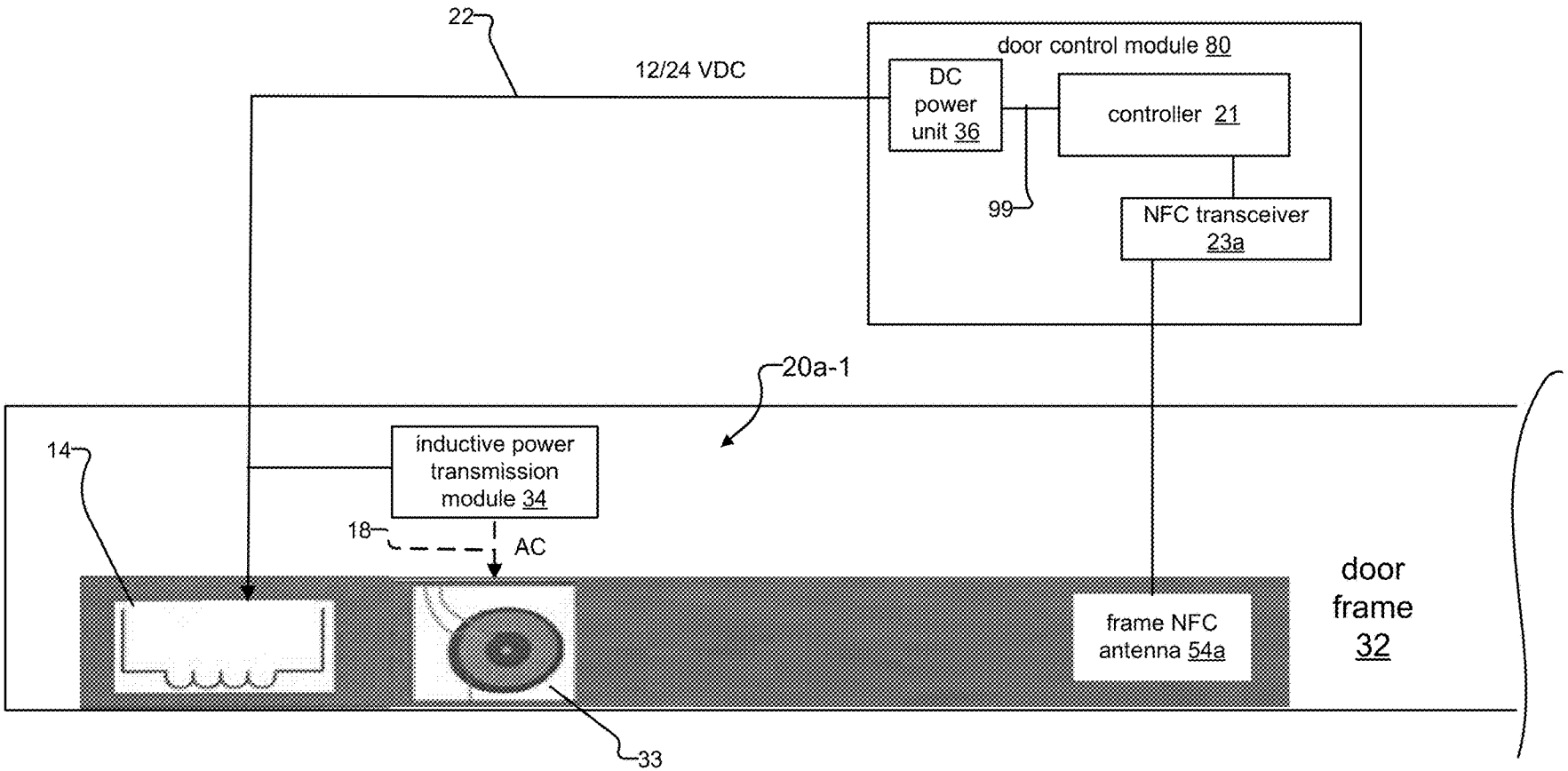
FIG. 2A shows detail for an embodiment of the frame magnetic lock assembly of the magnetic lock system in FIG. 1 and also shows components on a door frame side that interface with the frame magnetic lock assembly.

FIG. 2A shows detail for an embodiment of a door system 200 according to the invention. The system includes the frame magnetic lock assembly 20*a*-1 of the magnetic lock system 20 in FIG. 1 and also shows components on the door frame side of the magnetic lock system 20 that interface with the frame magnetic lock assembly.

The frame magnetic lock assembly 20*a*-1 includes a lock coil 14, an inductive power transmission module 34, an inductive power transmitter 33, and a frame Near Field Communications (NFC) antenna, or frame NFC antenna 54*a*. The door control module 80 includes a controller 21, a DC power unit 36, and an NFC transceiver 23*a*. The DC power unit 36 and the NFC transceiver 23*a* are under control of the controller 21. To enable NFC communications at the door 30, the NFC transceiver 23*a* is connected to the frame NFC antenna 54*a*.

In an alternate embodiment, NFC communications are not supported. In this embodiment, the door control module 80 does not include the NFC transceiver 23*a* and the frame magnetic lock assembly 20*a*-1 does not include the frame NFC antenna 54*a*.

The controller 21 controls the locking and unlocking of the door 30, in one example, by sending a control signal 99 to activate or deactivate the DC power unit 36. The DC power unit 36 provides a dc power signal 22 to power the lock coil 14, i.e., electromagnet, and the inductive power transmission module 34. Typically, the dc power signal 22 is either 12 or 24 VDC. To lock the door 30, the controller 21 sends a control signal 99 to activate the DC power unit 36, thus enabling the dc power signal 22. The inductive power transmission module 34, which is installed on the door frame 32, then provides an alternating current (ac) inductive power transfer signal 18 to an inductive power transmitter 33. To unlock the door 30, the controller 21 sends a control signal 99 that deactivates the DC power unit 36, thus disabling the dc power signal 22. Typically, when the door 30 is unlocked, the inductive power transfer signal 18 can also be disabled. In this situation, the door is often open thus preventing inductive power transfer.

An example of operation of the door control module 80 and the frame magnetic lock assembly 20*a*-1 when a user attempts to gain access to the building 90 via the access control system 100 is described below.

A user presents his/her user credentials 77 at the access reader 50 to obtain access to the building 90, through a normally closed and locked door 30. The door control module 80 sends the user credentials 77 over the network 13 to the central control system 42. The central control system 42 compares the received user credentials 77 to those of valid users in the database 15 to validate the users. If the user is a valid user, the controller 21 sends a control signal 99 to deactivate the DC power unit 36, thus disabling the dc power signal 22 to unlock the door 30.

Figure 2B:
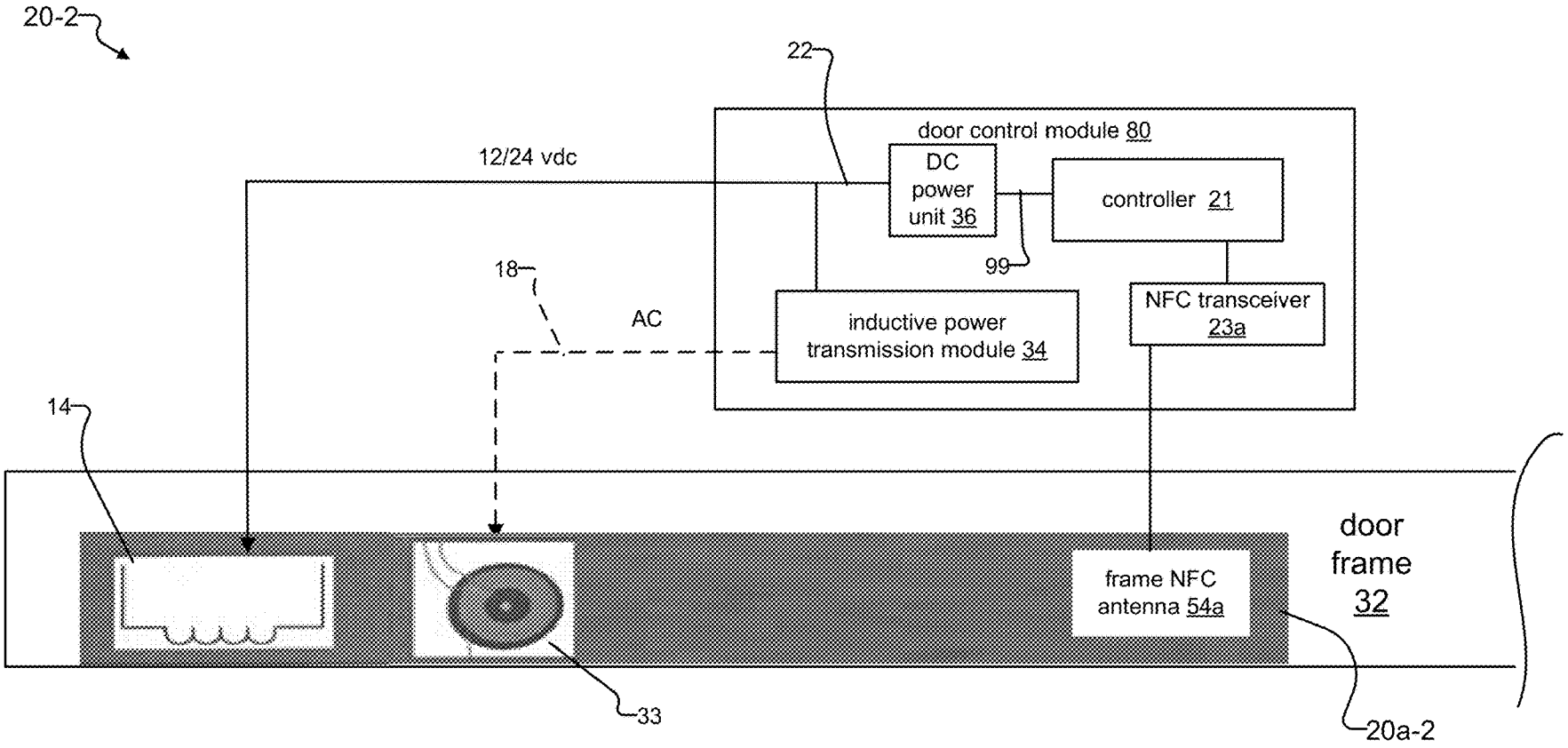
FIG. 2B shows detail for another embodiment of the frame magnetic lock assembly.

FIG. 2B shows detail for another embodiment of a frame magnetic lock assembly 20*a*-2, which is similar to and operates in a similar manner as the frame magnetic lock assembly 20*a*-1 in FIG. 2A.

However, the inductive power transmission module 34 is included within the door control module 80 rather than being located in the frame magnetic lock assembly 20*a*, as in FIG. 2A. The door control module 80 and frame magnetic lock assembly 20*a*-2 otherwise operate in a similar manner as the door control module 80 and frame magnetic lock assembly 20*a*-1 in FIG. 2A.

For example, as in the frame magnetic lock assembly 20*a*-1 of FIG. 2A, the controller 21 of the frame magnetic lock assembly 20*a*-2 locks the door 30 by sending a control signal 99 that instructs the DC power unit 36 to enable its dc power signal 22, which powers both the lock coil 14 and the inductive power transmission module 34. To unlock the door 30, the controller 21 sends a control signal 99 that instructs the DC power unit 36 to disable its dc power signal 22.

The frame magnetic lock assembly 20*a*-2 includes fewer components than in the frame magnetic lock assembly 20*a*-1 in FIG. 2A and therefore can be more easily manufactured, which lowers cost. As with the frame magnetic lock assembly 20*a*-2 in FIG. 2A, the frame magnetic lock assembly 20*a*-2 has an alternative embodiment that does not support NFC communications.

Figure 3:
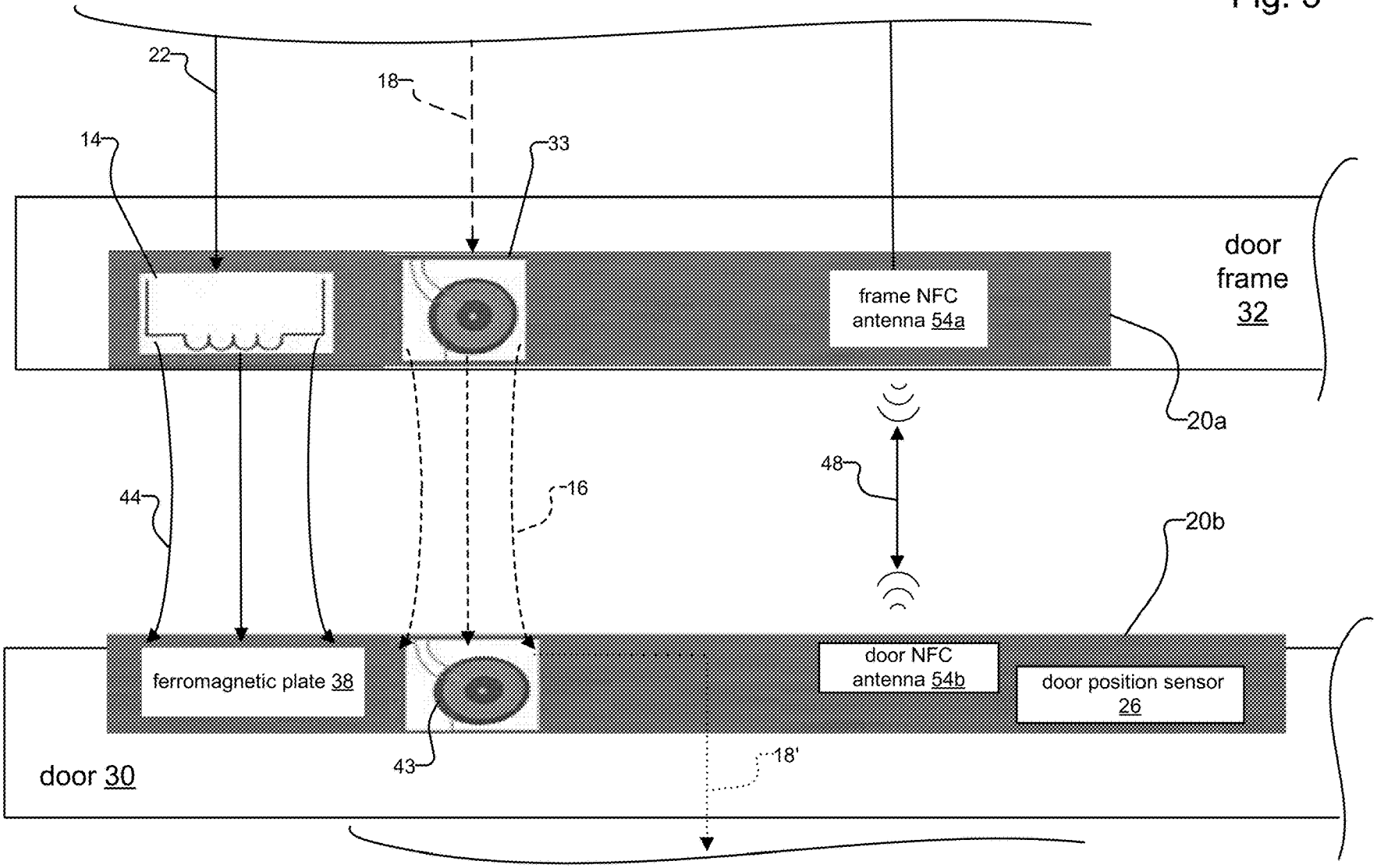
FIG. 3 shows more detail for the magnetic lock system, including interfacing and signals between the door magnetic lock assembly and the frame magnetic lock assembly.

FIG. 3 shows more detail for the magnetic lock 20 of the door system 200, including interfacing and signals between its frame magnetic lock assembly 20*a* and door magnetic lock assembly 20*b*.

The door magnetic lock assembly 20*b* includes a ferromagnetic plate 38, an inductive power receiver 43, a door NFC antenna 54*b*, and a door position sensor 26. The door 30 is normally closed and locked. When the door 30 is locked, the dc power signal 22 energizes the lock coil 14, which in turn applies a magnetic field 44 that attracts the ferromagnetic plate 38.

Additionally, the door frame 32 provides inductively transferred power 16 to the door 30. In more detail, the ac inductive power input signal 18 energizes the inductive power transmitter 33, which in turn creates inductively transferred power 16 in the form of a magnetic field that radiates toward the inductive power receiver 43. Through magnetic induction, the inductive power receiver 43 receives and transduces the magnetic signal into a door ac power signal 18' at the door.

When NFC communications are supported, an NFC communications link 48 is also established between the door frame 32 and the door 30. The NFC communications link 48 is established between the frame NFC antenna 54*a* of the frame magnetic lock assembly 20*a* and the door NFC antenna 54*b* of the door magnetic lock assembly 20*b*.

When the door control module 80 unlocks the door 30 by sending a control signal 99 to deactivate the DC power unit 36, neither the lock coil 14 nor the inductive power transmission module 34 receive the dc power signal 22 from the DC power unit 36. A user can enter the premises 90 at the door 30 because the lock coil 14 no longer generates the magnetic field 44 that normally attracts the ferromagnetic plate 38 with enough force to prevent the user from opening the door 30.

The door magnetic lock assembly 20*b* also no longer receives inductively transferred power 16 from the frame magnetic lock assembly 20*a* when the door control module 80 unlocks the door 30. Because the inductive power transmission module 34 has no source of power, the inductive power transmission module 34 cannot create the ac inductive power input signal 18 that, in turn, energizes the inductive power transmitter 33 of the frame magnetic lock assembly 20*a*. As a result, the inductive power transmitter 33 no longer provides the inductively transferred power 16 to the inductive power receiver 43 at the door 30 when the door 30 is open. Inductive power transfer is also prevented when the door is opened because of the resulting gap between the transmitter 33 and the receiver 43.

Figure 4:
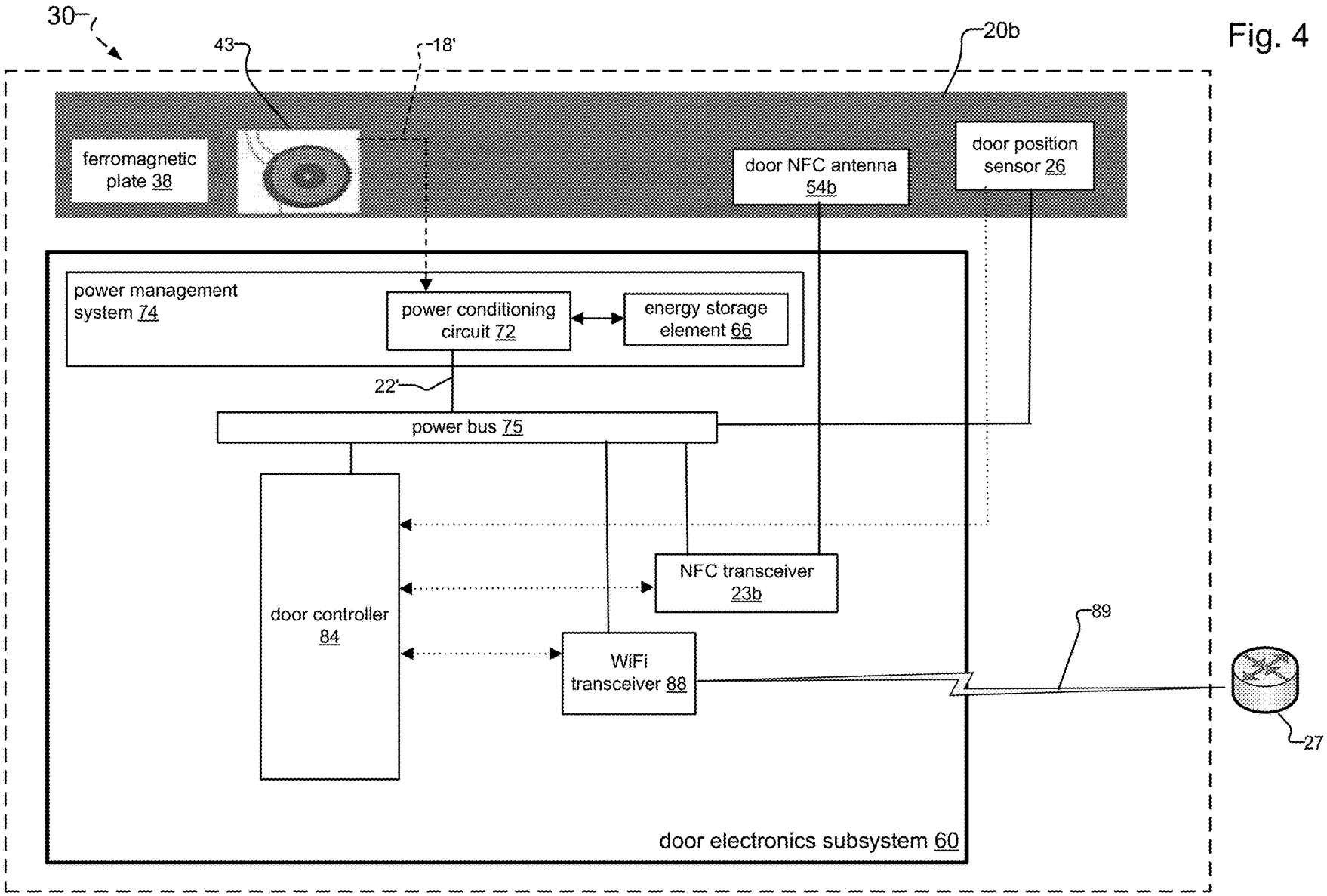
FIG. 4 shows more detail for components on the door side of the magnetic lock system.

FIG. 4 shows more detail for components on the door side of the door system 200.

The door 30 includes a door electronics subsystem 60 that is typically either mounted upon or integrated within the door 30. The door electronics subsystem 60 includes a power management system 74, a power bus 75, a door controller 84, an NFC transceiver 23*b*, and a WiFi transceiver 88. The power management system 74 includes a power conditioning circuit 72 and an energy storage element 66.

In an alternate embodiment, NFC communications are not supported. In this embodiment, the door control module 80 does not include the NFC transceiver 23*a* and the frame magnetic lock assembly 20*a*-1 does not include the frame NFC antenna 54*a*.

The power conditioning circuit 72 receives the door ac power input signal 18' from the inductive power receiver 43 and converts the door ac power input signal 18' to a door dc power signal 22'. In examples, the power conditioning circuit provides ripple reduction of the door ac power input signal and rectifies the door ac power input signal 18' into the door dc power signal 22'.

The door dc power signal 22' provides power to the door electronics subsystem 60 and other various components at the door 30 via the power bus 75. In examples, the power bus 75 distributes the door dc power signal 22' to the door position sensor 26, the door controller 84, which is typically a microcontroller, the WiFi transceiver 88, and the NFC transceiver 23*b*. The power conditioning circuit 72 also charges the energy storage element 66 with the door dc power signal 22'. In examples, the energy storage element 66 is a rechargeable energy source such as a supercapacitor or a rechargeable battery.

The inductively transferred power 16 is not available at the door 30 when the door is opened by a user and/or unlocked by the door control module 80 at the door frame 32, in examples. When the door 30 is opened by a user, the inductive power receiver 43 is no longer located near the inductive power transmitter 44. As a result, the magnetic field of the inductively transferred power 16 cannot energize the inductive power receiver 43. To unlock the door 30, the door control module 80 sends a control signal 99 to deactivate the DC power unit 36. When the door 30 deactivates the DC power unit 36, the inductive power transmitter 33 of the frame magnetic lock assembly 20*a* is not powered and therefore cannot create and provide the inductively transferred power 16 to the door 30.

However, when the inductively transferred power 16 is not available at the door 30, the power management system 74 can provide power to the door 30 via the stored door DC power signal 22' from the energy storage element 66. The power conditioning circuit 72 of the power management system 74 provides the stored door DC power signal 22' to the power bus 75, which in turn powers the door electronics subsystem 60 and possibly other components at the door 30. In this way, the power management system 74 can ride-through a disconnection of the inductively transferred power 16.

The power management system 74 also alternates between powering the door 30 via the inductively transferred power 16 and via the stored door DC power signal 22' from the energy storage element 66, based on the availability of the inductively transferred power 16 at the door 30. When the inductively transferred power 16 is not available, the power management system 74 powers the door 30 via the stored door dc power signal 22'. The power management system 74 can then switch back to providing power to the door 30 from the inductively transferred power 16 when the inductively transferred power 16 at the door 30 is restored.

The power management system 74 determines whether the inductively transferred power 16 is available at the door 30 via the power conditioning circuit 72. Because the inductive power receiver 43 creates the door ac power input signal 18' from the inductively transferred power 16, the power conditioning circuit 72 can inferentially determine the availability of the inductively transferred power 16 based upon the presence or absence of the door ac power input signal 18', in one example. In another example, the power conditioning circuit 72 can inferentially determine the availability of the inductively transferred power 16 based upon the quality of the door ac power input signal 18'. For example, if the voltage, waveform, and/or frequency of the door ac power input signal 18' are insufficient for conversion into the door dc power signal 22', the power management circuit 72 can conclude that the inductively transferred power 16 is effectively unavailable at the door 30.

In any event, when the door ac power input signal 18' is restored, then the power conditioning circuit 72 uses some of the input power to recharge the energy storage element 66 so that it is fully charged for the next time the door 30 is opened. The remaining power from the door ac input signal 18' is used to provide power on the power bus 75 and to the other components of the door electronics subsystem 60.

The door controller 84 receives an indication that the door 30 is open and/or closed from the door position sensor 26 and controls the NFC transceiver 23*b* and the WiFi transceiver 88. The WiFi transceiver 88 establishes a WiFi link 89 to the WiFi access point 27, which in turn communicates with the door control module 80 via the local network 13. This enables bidirectional WiFi communications between the door frame 32 and the door 30.

In a similar fashion, the NFC transceiver 23*b* is connected to the door NFC antenna 54*b*, which also enables bidirectional NFC communications between the door frame 32 and the door 30.

While this invention has been particularly shown and described with references to preferred embodiments thereof, it will be understood by those skilled in the art that various changes in form and details may be made therein without departing from the scope of the invention encompassed by the appended claims.

What is claimed is:

1. A system for providing power to a magnetic lock system for a door, the system comprising:

a frame magnetic lock assembly mounted to a door frame for the door, the frame magnetic lock assembly including a lock coil and an inductive power transmitter; and a door magnetic lock assembly mounted to the door, the door magnetic lock assembly comprising an inductive power receiver for receiving inductively transferred power from the inductive power transmitter of the frame magnetic lock assembly, the door magnetic lock assembly including a ferromagnetic plate for locking the door when the lock coil is energized thereby generating a magnetic field to attract the ferromagnetic plate to the lock coil.

2. The system of claim 1, further comprising a door electronics subsystem mounted to the door that includes:

a power management system that provides power to components of the door from the inductively transferred power;

a power bus that distributes the power from the power management system the components of the door; and a door controller that is powered by the power bus.

3. The system of claim 2, further comprising a WiFi transceiver that provides data communication for the door controller and is powered via the power bus.

4. The system of claim 2, wherein the power management system comprises:

an energy storage element; and a power conditioning circuit that converts an AC power signal transduced from the inductively transferred power into a door DC power signal and charges the energy storage element with the door DC power signal.

5. The system of claim 1, wherein the door magnetic lock assembly includes a door position sensor that indicates an open and/or closed state of the door.

6. The system of claim 1, wherein the frame magnetic lock assembly further comprises a frame communications antenna, connected to a frame communications transceiver, and the door magnetic lock assembly further comprises a door communications antenna, connected to a door communications transceiver, for enabling communications between the door and the door frame.

7. The system of claim 6, wherein the frame communications transceiver and the door communications transceiver are near field communications (NFC) transceivers.

8. An access control system, comprising:

a door control module for controlling locking and unlocking of a door;

a frame magnetic lock assembly mounted to a door frame for the door, the frame magnetic lock assembly including a lock coil and an inductive power transmitter; and a door magnetic lock assembly mounted to all the door, the door magnetic lock assembly comprising an inductive power receiver for receiving inductively transferred power from the inductive power transmitter of the frame magnetic lock assembly, the door magnetic lock assembly including a ferromagnetic plate for locking the door when the lock coil is energized thereby generating a magnetic field to attract the ferromagnetic plate to the lock coil.

9. A method for providing power to a magnetic lock system, the method comprising:

receiving, by an inductive power receiver of a door magnetic lock assembly mounted to a door, inductively transferred power from an inductive power transmitter of a frame magnetic lock assembly mounted to a door frame for the door, the door magnetic lock assembly including a. ferromagnetic plate for locking the door when a lock coil of the frame magnetic lock assembly is energized thereby generating a magnetic field to attract the ferromagnetic plate to the lock coil.

10. The method of claim 9, further comprising providing, by a power management system mounted to the door, power to components of the door from the inductively transferred power.

11. The method of claim 10, wherein providing power to the components of the door from the inductively transferred power comprises converting an AC power signal transduced from the inductively transferred power into a door DC power signal, and charging an energy storage element on the door with the door DC power signal.

12. The method of claim 11, further comprising providing power to the components of the door from the energy storage element when the door is open.

13. The method of claim 11, further comprising providing power to the components of the door from the energy storage element in response to a door control module at the door frame unlocking the door, the door control module unlocking the door by deactivating a DC power unit that supplies power to the frame magnetic lock assembly.

14. The method of claim 11, further comprising providing power to the components of the door from the energy storage element when the inductively transferred power at the door is absent, and resuming providing power to the components of the door from the inductively transferred power when the inductively transferred power at the door is restored.

15. The method of claim 9, further comprising a door position sensor sending an indication of an open and/or closed state of the door to a door controller at the door.

16. The method of claim 9, further comprising enabling communications between the door and the door frame.

17. The system of claim 1, wherein the frame magnetic lock assembly receives power from a door control module for controlling locking and unlocking of the door.

18. The system of claim 17, wherein a DC power unit of the door control module provides a DC power signal to power both the lock coil and the inductive power transmitter.

19. The system of claim 18, wherein the door control module locks the door by activating the DC power unit to enable the DC power signal, resulting in the inductive power transmitter inductively transmitting power to the door magnetic lock assembly via the inductive power receiver.

20. The system of claim 18, wherein the door control module unlocks the door by deactivating the DC power unit to disable the DC power signal, resulting in neither the lock coil nor the inductive power transmitter receiving the DC power signal and preventing inductive power transfer by the inductive power transmitter when the door is unlocked and/or opened.

* * * * *